US007002121B2

(12) United States Patent
Monteleone et al.

(10) Patent No.: US 7,002,121 B2
(45) Date of Patent: Feb. 21, 2006

(54) STEAM GENERATOR

(76) Inventors: Alfred Monteleone, 189 Rabbit Run Rd., Clintondale, NY (US) 12515-5008; Brian Weit, 75 Long Rung Rd., Rhinebeck, NY (US) 12572

( * ) Notice: Subject to any disclaimer, the term of this patent is extended or adjusted under 35 U.S.C. 154(b) by 44 days.

(21) Appl. No.: 10/858,955

(22) Filed: Jun. 2, 2004

(65) Prior Publication Data

US 2005/0269316 A1 Dec. 8, 2005

(51) Int. Cl.
*H05B 6/80* (2006.01)
*H05B 6/64* (2006.01)

(52) U.S. Cl. ..... 219/688; 219/678

(58) Field of Classification Search ..... 219/688, 219/687, 689, 678; 126/344–363.1
See application file for complete search history.

(56) References Cited

U.S. PATENT DOCUMENTS 1,496,839 A 6/1924 Bohan et al.
2,739,014 A 3/1956 Bush
3,440,386 A * 4/1969 Boehm ..... 219/757
3,672,048 A 6/1972 Coswell
3,778,578 A 12/1973 Long et al.
3,794,801 A 2/1974 Long et al.
3,816,689 A 6/1974 Long
5,179,259 A * 1/1993 Martin ..... 219/688
5,191,766 A 3/1993 Vines
6,133,558 A * 10/2000 Ueda et al. ..... 219/682
6,858,824 B1 * 2/2005 Monteleone et al. ..... 219/688

* cited by examiner

*Primary Examiner*—Daniel Robinson

(57) ABSTRACT

A steam generator is located within a tank. At one end of the tank there is a flange. Mounted on the outside of the flange there is a magnetron that is cooled by a fan surrounding the magnetron. A heat tube extends from the magnetron into the tank. Within the heat tube there is a block of silicon carbide which has a passageway through it. The magnetron fires microwave energy down the passageway heating the block of silicon carbide and the heat tube. Water tubes about the inside surface of the tank spray a mist of water on the heat tube to produce steam which is removed by a steam line through ports at the opposite end of the tank from the magnetron.

The steam may be used for many purposes but in a vehicle it may be injected into the cylinders of a four stroke internal combustion engine through the openings for the spark plugs. Make up water is collected from the dehumidifier. Water is recovered from the crankcase by a float system, and returned to the storage container.

20 Claims, 8 Drawing Sheets

STEAM GENERATOR

BACKGROUND OF THE INVENTION

1. Field of the Invention

This invention relates to a steam generator and more specifically to a steam generator utilizing microwave heat. The steam generator is capable of use as a stationary unit and for a propulsion system in a vehicle. The conversion of electrical energy to steam permits the use of the millions of existing motor vehicles already constructed with internal combustion engines.

2. Prior Art

Earlier patents have dealt with the use of microwave energy to generate steam and also to use the steam to propel a vehicle with the steam produced. Two Long, et al patents, U.S. Pat. No. 3,778,578 and U.S. Pat. No. 3,794,801 show the concept of steam generation by the use of microwave energy and the use of the steam so generated to propel a vehicle. Interestingly, neither of these patents disclosed the source of electrical power to operate the steam powered vehicle. Both of the Long, et al patents generate the steam in a coil. Another patent, Long, U.S. Pat. No. 3,816,689 is similar to both Long et al patents but teaches the use of silicon carbide particle about the coils.

Objects

The objects of the invention are;

To provide an efficient steam generator that is adaptable both as a stationary steam generator and as a source of propulsion for a vehicle including existing vehicles with internal combustion engines.

To provide a steam generator that is sufficiently limited in weight and size to permit it's use in a vehicle as the propulsion system.

To provide a steam generator that is economical to operate.

To provide a steam generator system that is comparatively reasonable in cost to construct.

SUMMARY OF THE INVENTION

A steam generator is provided which includes a tank. The tank has an inner surface and is open at one end. The opposite end has at least one port. At least one water line extends along the length of the tank and has jets to spray a mist of water. A flange is mounted on the open end of the tank and a magnetron is mounted in the flange. The magnetron includes a means to cool the magnetron. A heat tube extends from the magnetron into the tank. A block of silicon carbide is located within the heat tube. The silicon carbide has a passageway through it which passage is connected to the magnetron. There is a means for supplying power to the magnetron to activate the magnetron. There is also a means to supply water to the water line. A means is connected to the port for delivery of steam from the tank.

DESCRIPTION OF THE NUMERALS

Figures 1, 2:
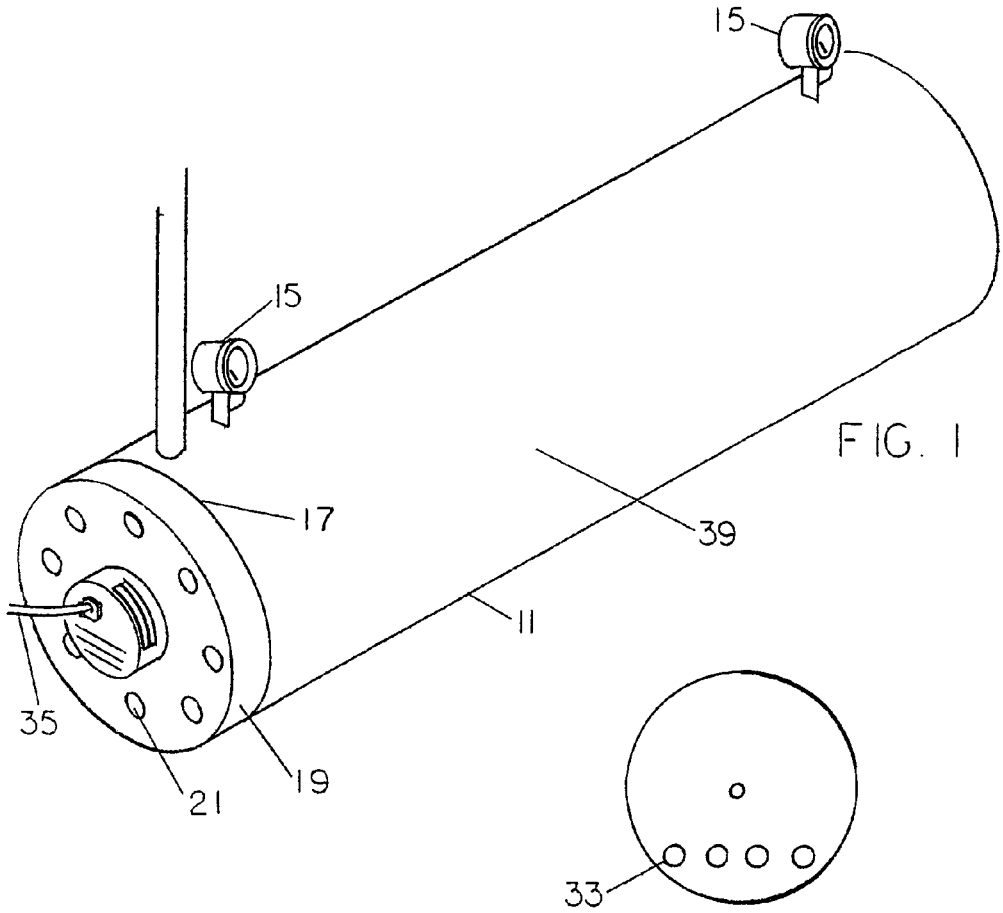
FIG. 1 is an exploded pictorial view of the steam generating tank with a magnetron and cooling fan and also showing the heat tube with water lines
FIG. 2 is a plan view of the closed end of the steam generator opposite from the magnetron showing the parts where steam from the steam generator exits the tank.

| NUMERAL | DESCRIPTION |
|---|---|
| 11 | Tank |
| 13 | Magnetron |
| 15 | Pressure Gauge |
| 17 | Open End |
| 19 | Flange |
| 21 | Bolts |
| 23 | Inside Surface |
| 25 | Outside Surface |
| 27 | Cooling Fan |
| 29 | Heat Tube |
| 31 | Closed End |
| 33 | Ports |
| 35 | Power Line |
| 37 | Inside Surface |
| 39 | Outside Surface |
| 41 | Water Lines |
| 43 | Pin Sprayers |
| 45 | Block |
| 47 | Interior Surface |
| 48 | Passageway |
| 49 | Ends |
| 51 | Smallest Diameter |
| 53 | Steam Line |
| 55 | Engine |
| 57 | Ball Valve |
| 59 | Crankcase |
| 61 | Float |
| 63 | Pump |
| 64 | Separator Line |
| 65 | Filter |
| 66 | Storage Container |
| 67 | Switch |
| 69 | Dehumidifier |
| 71 | Make-up Pump |
| 72 | Make-up Filter |
| 73 | Make-up Line |
| 74 | Distributor |
| 75 | Manifold |
| 77 | Recycle Line |
| 79 | Recycle Pump |
| 80 | Storage Line |
| 81 | Float |
| 83 | Switch |
| 85 | Gauge |
| 93 | Vehicle |
| 95 | Solar Panels |

-continued

DESCRIPTION OF THE NUMERALS

| NUMERAL | DESCRIPTION |
|---|---|
| 97 | Magnetos |
| 99 | Wheel |
| 101 | Outer Ring |
| 103 | Magnets |
| 105 | Inner Ring |
| 107 | Coil |
| 109 | Alternate Current |
| 110 | Power Source |
| 111 | Inverter |
| 112 | General Electrical System |
| 113 | Computer |
| 115 | Batteries |
| 121 | Battery One |
| 123 | Battery Two |
| 125 | Battery Ten |
| 129 | Battery Three |
| 131 | Battery Four |

DETAILED DESCRIPTION OF THE PREFERRED EMBODIMENT

The steam generator is enclosed within a tank 11 with a magnetron 13 mounted on the outside of the tank 11 and pressure gauges 15 also located on the outside of the tank 11. The pressure gauge 15 also serves as a blow off valve. The tank 11 has an open end 17. A flange 19 is secured by bolts 21 to the open end 17. The tank 11 has an inside surface 23 and an outside surface 25. A cooling fan 27 surrounds the magnetron 13 which is mounted on the flange 19.

A heat tube 29 extends from the magnetron 13 through the flange 19 into the tank 11. One or more ports 33, as shown in FIG. 2, are located in a closed end of the tank 11 which is the end opposite from the flange 19. The ports 33 permit removal of the steam from the tank 11. Power to the magnetron 13 is supplied through a power line 35. The tank 11 has an inside surface 37 and an outside surface 39.

Figure 3:
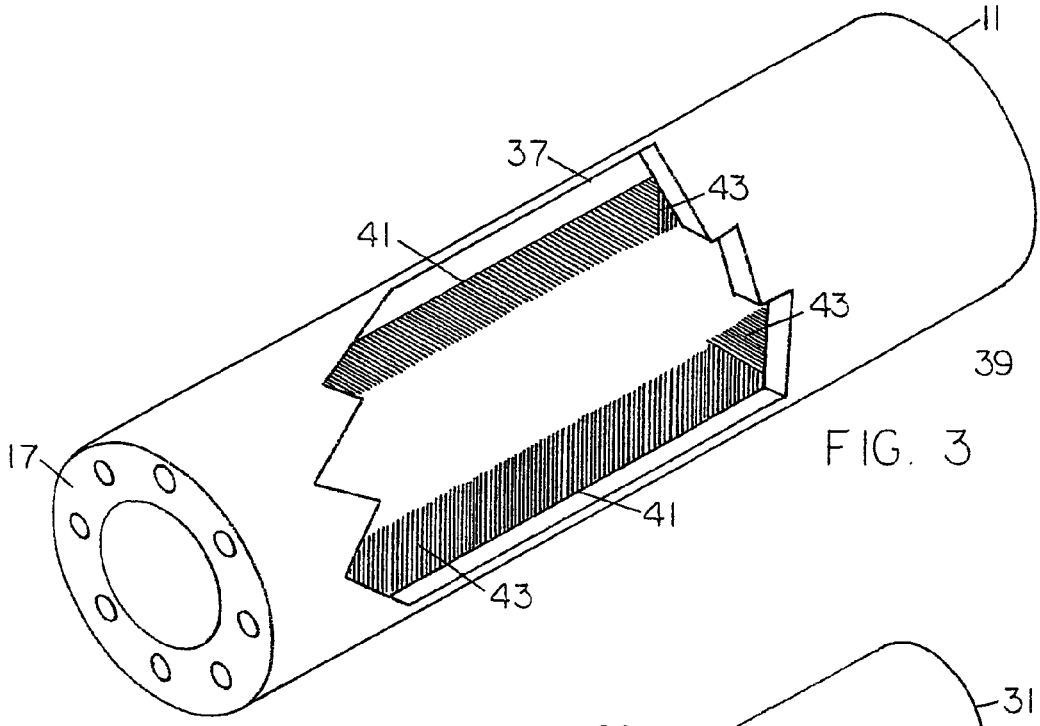
FIG. 3 is a pictorial view of the steam generator with the tank cut away to show four water lines which deliver a comb of mist.

In FIG. 3 the tank 11 is shown with the magnetron 13 removed. Also, in FIG. 3, multiple water lines 41 are shown which extend longitudinal adjacent to the inside surface 23 of the tank 11. Preferably there are four such water lines 41 and the four water lines 41 are located substantially ninety degrees apart.

The water lines 41 include, in close proximity to one another, pin sprayers 43 to produce a comb of mist which impinges upon the heat tube 29.

Figure 4:
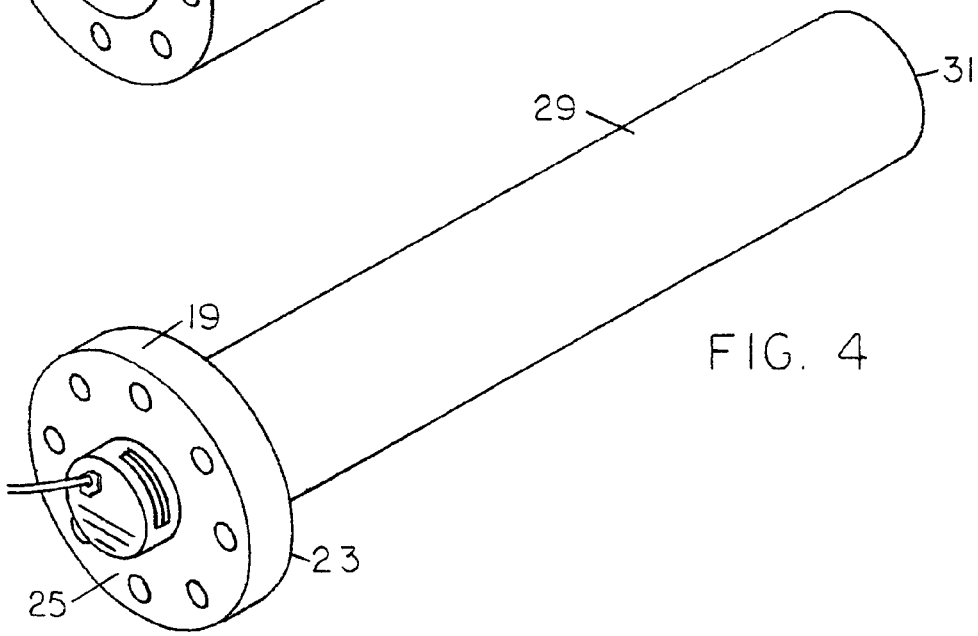
FIG. 4 is a pictorial view of the magnetron and flange with the heat tubes extending from the flange and magnetron.

As previously stated, the heat tube 29 extends from the magnetron 13, as shown in FIG. 4. The heat tube 29 extends for most of the length of the tank 11. The heat tube 29 is preferably made of stainless steel. Within the heat tube 29 is a block 45 of silicon carbide. The heat tube 29 has an interior surface 47. The block 45 is cylindrical and fits against the interior surface 47 of the heat tube 29, which is also cylindrical. The block 45 has a passageway 48 through it which has its largest diameter at both ends 49 and is tapered to it's smallest diameter 51 generally at the mid point of the block 45. The passageway 48 has a cross-sectional area which generally circular.

Figure 5:
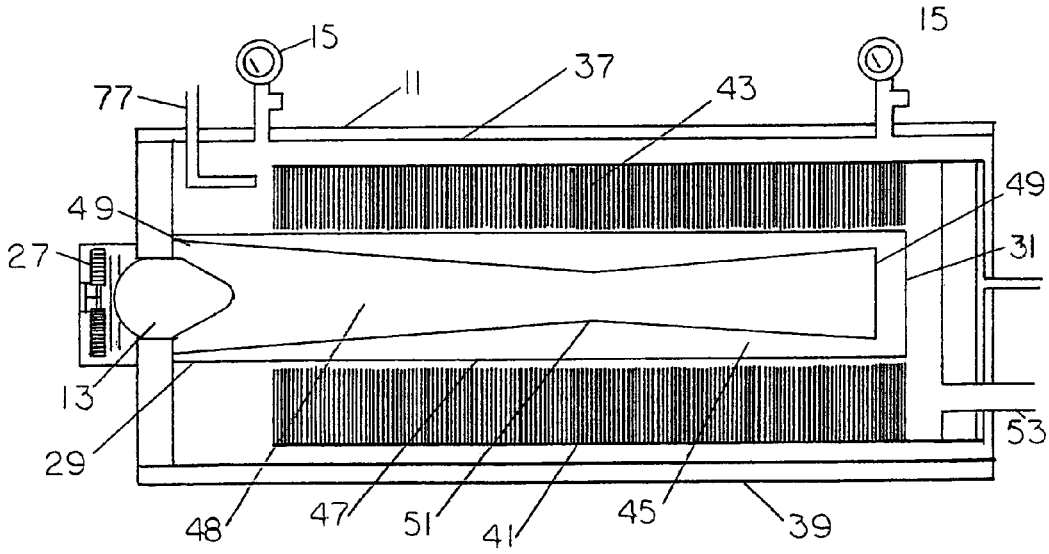
FIG. 5 is a cross sectional view of the tank and heat tubes showing the block of silicon carbide within the heat tube.

The magnetron 13 fires microwave energy into the passageway 48 heating the block 45. This in turn heats the heat tube 29. As the mist of water from the water lines 41 impinges on the heat tube 29, steam is produced which accumulates and creates increased pressure within the tank 11. As seen in FIG. 5, the steam is removed by at least one steam line 53, and the steam may be utilized in many ways, one of which is a vehicle. The number of steam lines 53 is the same as the number of cylinders of the engine 55. Alternate ways of using the steam would include for example, in a stationary unit, for heating a building. It may also be used for any commercial use such as steam cleaning.

Figure 6:
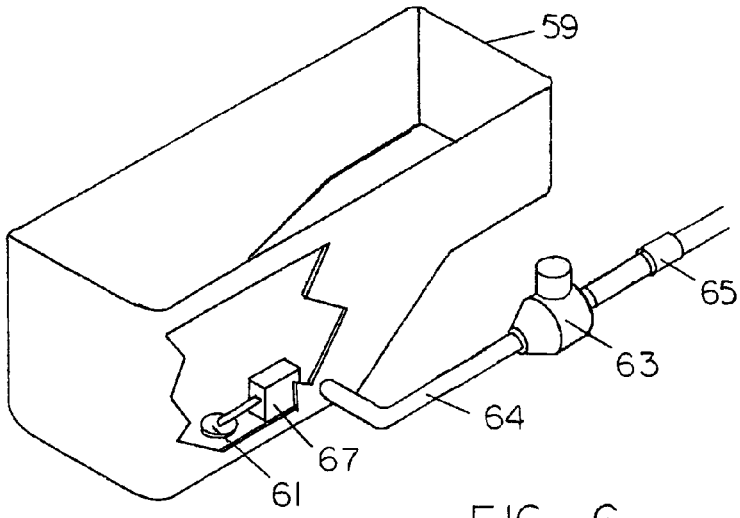
FIG. 6 is a pictorial view of the crankcase of the engine showing a float within the crankcase and the separator and pump.
Figure 7:
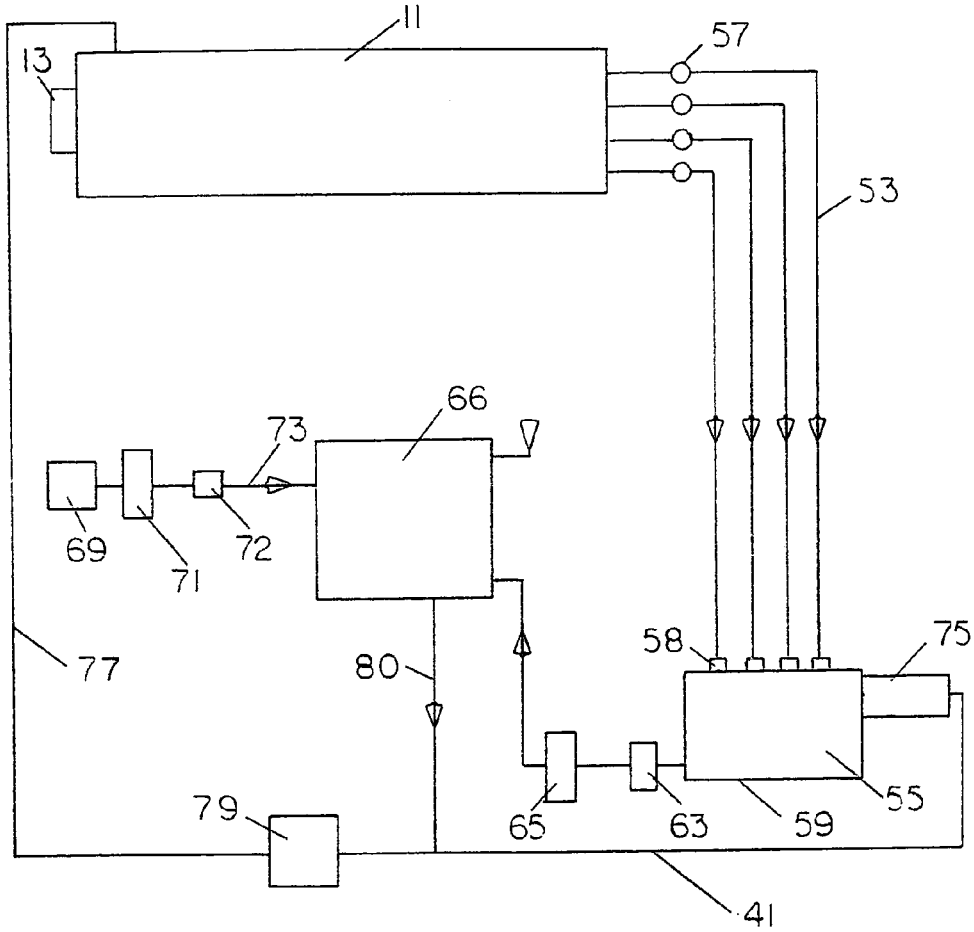
FIG. 7 is a schematic diagram of the flow of steam and water to and from the steam generator and an engine
Figure 8:
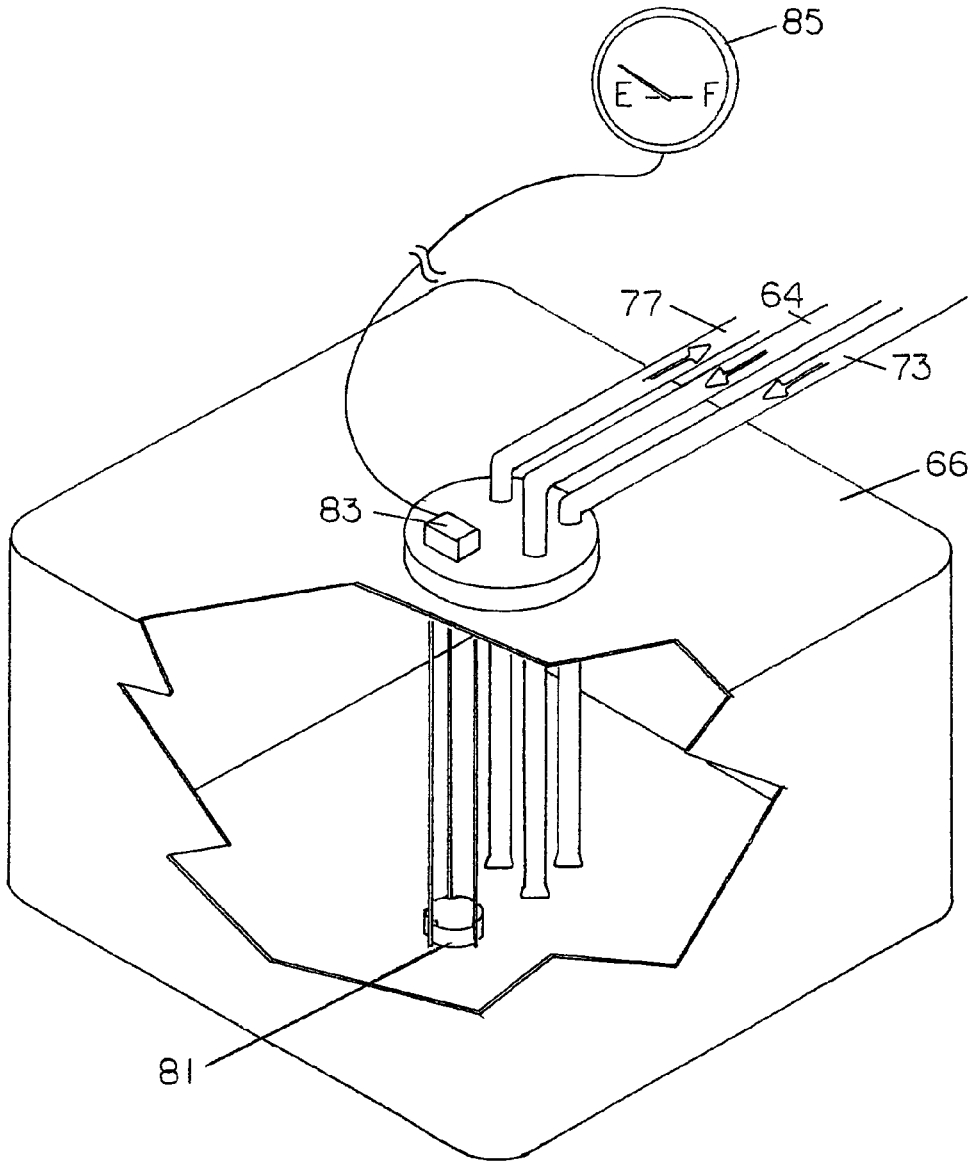
FIG. 8 is a pictorial view of the storage container showing the float to indicate water level and showing the flow of water into and out of the storage container.

In FIG. 7, a flow diagram is shown of the path of the steam, including the use of the steam in an engine and the return of the water from condensed steam to the tank 11 to be again used to produce steam. The tank 11 is again shown in FIG. 7 with the magnetron 13. The steam lines 53 are shown leaving the tank 11 at the closed end 31 opposite from the magnetron 13 since the engine 55 is a four-cylinder engine, there are four steam lines 53 connected to the ports 33 shown in FIG. 2. In each steam line 53, there is a ball valve 57. The steam lines 53 are connected directly to the engine 58 at the opening originally intended for the spark plug. The four-cylinder engine 55 is a four stroke gasoline engine converted to operate on steam. A ball valve 57 is located in each steam line 53 to control the rate of delivery of steam to the engine 55 and the sequence of delivery of steam to each of the four cylinders of the engine 55. In FIG. 6, the crankcase 59 of the engine 55 is shown. When an internal combustion engine is used as a steam engine, water produced by the condensing of the steam in the cylinders runs down the cylinders past the piston rings and into the crankcase 59. This water represents only a small portion of the water condensed from the steam but it is still significant and must be removed from the crankcase 59.

The oil in the crankcase 59 floats on the water and a float 61 which rides on the water is used to control the removal of the water. Once the water reaches a specified depth, a pump 63 in a separator line 64 which is connected to the crankcase 59, is activated. The pump 63 forces the water through a filter 65 to remove any retained oil. The separator line 64 is also connected to a storage container 66 where the water is accumulated. When the water level in the crankcase 59 drops to a predetermined level, the float 61 drops and turns off a switch 67 which terminates the removal of water from the crankcase 59.

The source of make-up water is a dehumidifier 69 which collects water from the atmosphere. A make-up pump 71 forces the make-up water through a make-up filter 72 into the storage container 66 by means of a make-up line 73.

As previously stated, the engine 55 being used as an example is a four-cylinder engine. The same approach would be used for a six or eight cylinder engine. Since the engine 55 in FIG. 7 is four-cylinder engine, four steam lines 53 are affixed to the ports 33 in the tank 11 as shown in FIG. 2. The sequence of the discharge of steam into the cylinders is controlled by a distributor 74, which in turn controls the ball valves 57. The steam leaving the cylinders is discharged into the existing manifold 75 of the engine 55 where it condenses to water.

The water formed in the manifold 75 from exhaust steam is returned to the steam generator and more specifically, the water lines 41, in the steam generator by a recycle line 77. The water in the recycle line 77 is freed into the water line 41 by a recycle pump 79.

The storage container 66 is also connected to the recycle line 77 to supply by a storage line 80 additional water from the storage container 66 as needed. Inside the storage 66 is a float 81. The float 81, which detects the level of water in the storage container 66, is connected to a switch 83 which provides a signal to the gauge 85, most usually located on the dash board of the vehicle 93.

Figure 9:
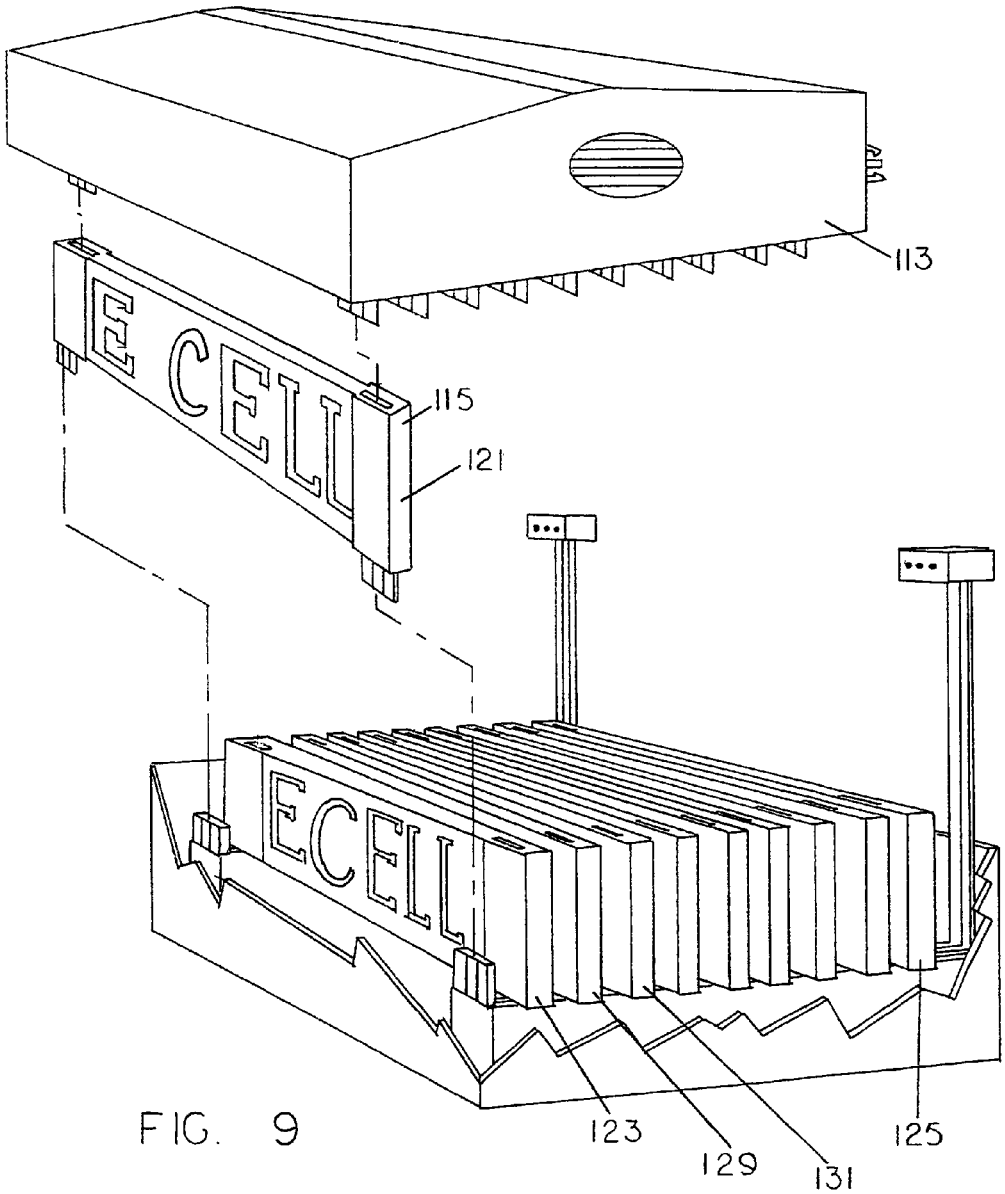
FIG. 9 is an exploded pictorial view of the computer and battery pack.
Figure 10:
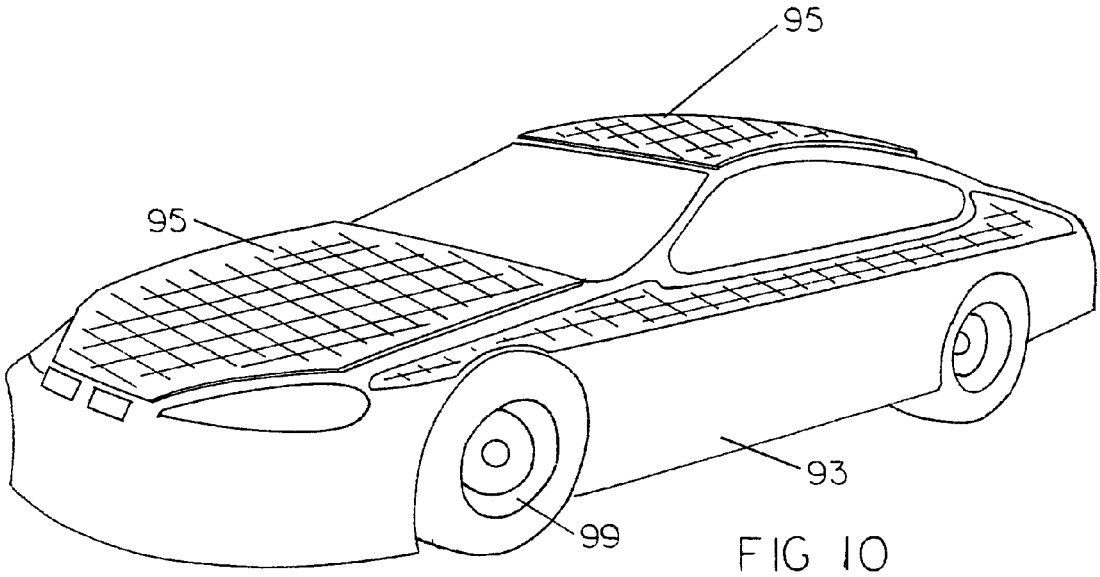
FIG. 10 is a pictorial view of an automobile

The vehicle 93, namely a two-door car is shown in FIG. 9. The upper surfaces of the vehicle 93 car are completely covered with solar panels 95, to produce electrical power from the solar panels 95 to operate the steam generator.

Additionally electric power is produced by magnetos 97 pictured on each wheel 99 of the vehicle 93. An outer ring 101 has magnets 103 mounted on it. The outer ring 101 rotates with the wheel on which it is mounted. On an inner ring 105 which does not rotate, coils 107 are located. As the magnets 103 rotate past the coils 107, electricity is generated in the coils 107.

Figure 11:
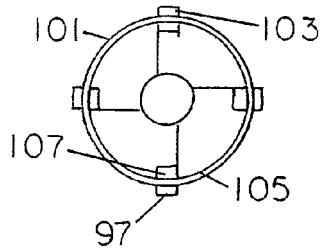
FIG. 11 Is from elevation of a magneto mounted on a wheel hub.

A schematic diagram of the electrical circuitry is shown in FIG. 11. Power may be supplied by an alternating current source 109. This, most likely is from a standard plug such as is available in residential and commercial property. The electrical power from the magnetos 97 is also used along with the electrical power from the solar panels 95. Both the magnetos 97 and the solar panels 95 produce twelve volt direct current. Together, a power source 110 is formed from the alternate current source 109 and the magnetos 97 and the solar panels 95.

The alternating power source 109 and the magnetos 97 and the solar panels 95 are all fed into an inverter 111. Inverters 111 are well known and are adaptable to each specific application. In this case, the inverter 111 takes a combination of different power sources, that may vary as to input at different times and converts that available power to both generally one hundred ten volt alternating current and twelve volt direct current that must be used to power the magnetron 13. The general electrical system 112 of the vehicle 93 such as lights and horn operate on twelve volt direct current.

A computer 113 which controls batteries 115 operates on twelve volt direct current as does the distributor 74 which controls the activation of the ball valves 57 in the steam lines 53.

Figure 12:
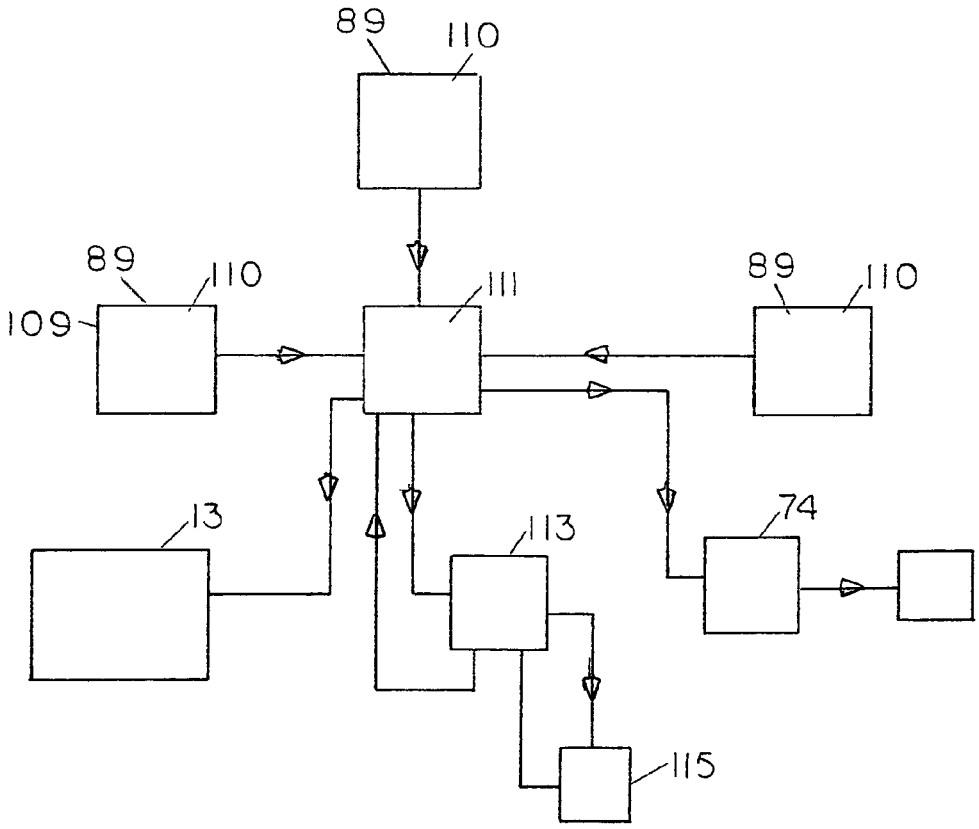
FIG. 12 is a schematic of the electrical current of the steam generator in a vehicle with an internal combustion engine.

Referring to FIG. 12, the batteries 115 are shown as a group often batteries 115. Above the batteries 115 is the computer 113. The batteries 115 are aligned as shown, namely number one through number ten. The batteries 115 provide twelve volt direct current, which as shown in FIG. 11 is supplied to the power source 110 through the inverter 111 and which are recharged with the power source 98.

The computer 113 selects which battery 115 is first used and only one battery 115 at a time is discharged. At start up, the battery one 121 is preferably selected first. All the other batteries 115, namely batteries two 123 through ten 125, while battery one 121 is being discharged, are continued with a trickle charge.

When battery one 121 is discharged, battery two 123 begins discharge. Battery one 121 is supplied a fast charge and batteries three 129 through battery ten 125 remain on trickle charge. When battery two 123 is drained of power, batteries three 129 is placed on discharge and battery two 123 placed on fast charge. Battery one 121 and battery four 131 think battery ten 125 remain on trickle charge. This cycle continues through battery ten 125. The battery 115 just discharged is placed on fast charge and all other batteries 115 except that battery 115 just discharged and the one battery 115 currently on discharge are placed on trickle charged.

While a preferred embodiment has been shown and described, it will be apparent to those skilled in the art that many other changes and modifications may be made without departing from the invention in it's broader aspects. The appended claims are therefore intended to cover all such changes and modifications as fall within the true spirit and scope of the invention.

The invention claimed is:

1. A steam generator comprising;

a tank having any inner surface, the tank being open at one end and having at least one opening at the opposite end;

at least one water line extending along the length of the tank and having jets to spray a mist of water;

a flange mounted on the end of the tank that is open;

a magnetron mounted on the flange;

means for cooling the magnetron;

a heat tube extending from the magnetron into the tank;

a block of silicon carbide within the heat tube and having a passageway through it, the passageway being connected to the magnetron;

means for supplying power to the magnetron to activate the magnetron;

means for supplying water to the water line;

and means connected to the opening in the end tank for the delivery of steam from the tank.

2. a steam generator according claim 1 wherein there are four water lines generally adjacent to the inner wall of the tank and spaced ninety degrees from one another.

3. A steam generator according to claim 1 wherein the tank has a longitudinal centerline, the passageway through the block being located along the longitudinal centerline.

4. A stream generator according to claim 1 wherein the passageway through the block tapers from both ends, being the smallest approximately midway between both ends.

5. A steam generator according to claim 1 further including at least one blow off valve and pressure gauge.

6. A steam generator according to claim 1 wherein the means for supplying power to the magnetron includes at least one source of electrical power and an inverter to produce both approximately twelve volt direct current and approximately one hundred ten volt alternating current.

7. A steam generator according to claim 1 wherein the means for supplying water to the water line includes a storage container and a recycle line connected to the storage container.

8. A steam generator according to claim 1 further including:

a means for utilizing the steam to provide rotational power;

means to condense the steam utilized to provide rotational power;

a condenser line connected to the means to condense the steam; and wherein the means for supplying water to the water line includes a storage container and a recycle line connected to the storage container, the condenser line being connected to the recycle line.

9. A steam generator comprising:

a tank having an inner surface and a longitudinal centerline and having two ends, one end being open and the opposite end being closed and having at least one opening through it; a plurality of water lines located along the inner surface of the tank and being generally equally spaced from one another; means including an inverter for supplying power to a activate the magnetron;

a supply line;

means including a water container connected to the supply line to supply water to the plurality of water lines;

a steam line connected to the opening in the end of the tank that is closed for the delivery of steam from the tank; and valve means located in the steam line.

10. a steam generator according claim 9 wherein there are four water lines generally adjacent to the inner wall of the tank and spaced ninety degrees from one another.

11. A stream generator according to claim 9 wherein the passageway through the block tapers from both ends, and is the smallest at approximately midway between both ends.

12. A stream generator according to claim 9 wherein the passageway through the block tapers from both ends, the smallest approximately midway between both ends.

13. A stream generator according to claim 9 wherein the means for supplying power to activate the magnetron includes solar panels.

14. A steam generator according to claim 9 further including an engine, the steam line being connected to the engine.

15. A steam generator according to claim 9 further including an engine, the steam line being connected to the engine, the engine having a manifold; and a recycle line connected to the manifold and to the supply line.

16. A steam generator according to claim 9 wherein the engine includes a crankcase and further including;

a float located in the crankcase;

a switch connected to the float and activated by the float;

a separate line connected to the crankcase and to the storage container; and a pump activated by the switch located in the separate line.

17. A steam generator comprising;

a tank having a circular cross section and having an inner surface and a longitudinal centerline, the tank being open at one end and being closed at the other end and having a plurality of ports through the end which is closed;

four water lines extending substantially along the length of the tank and being located adjacent to the inside surface, each water line being located about the tank approximately ninety degrees apart from one another, each water line having jets to provide a water mist along their length;

a flange mounted on the end of the tank that is open;

a magnetron mounted on the flange;

a heat tube having two ends extending from the magnetron into the tank along the longitudinal centerline of the tank to another end;

a block of silicon carbide within the heat tube, the block having a passageway generally concentrically located within it and extending from the magnetron to adjacent the opposite end of the heat tube, the passageway through the block tapering from both ends of the heat tube and having it's smallest cross section area approximately midway between both ends of the heat tube;

a cooling fan mounted on the magnetron to cool the magnetron;

a pair of blow off valves and pressure gauges mounted on the tank;

a plurality of steam lines connected to the ports in the tank;

a ball valve located in each steam line to control the flow of steam through the steam line;

an engine having a plurality of cylinders, a manifold and a crankcase, each steam line being connected to a cylinder in the engine, the manifold being connected to the cylinders;

a recycle line connected to the manifold and a make up line connected to the recycle line, the recycle line being connected to the water lines;

a recycle pump located in the recycle line;

an electrical power source;

an inverter connected to the power supply to produce from the power supply both alternating current and direct current, the magnetron being connected to the inverter to be supplied approximately one hundred ten volt alternating current;

a distributor to operate the ball valves in the required sequence, the distributor being connected to the inverter to receive direct current;

a plurality of batteries connected to the inverter charged to augment the alternating current and direct current supplied by the inverter;

a computer connected to the inverter to receive power from the inverter and supply power to the inverter, the batteries being connected to the computer, the computer controlling each sequence of use of each of the batteries and the recharging of the batteries.

18. A steam generator according to claim 17 further including;

a float located in the crankcase;

a switch connected to the float and activated by the float;

a separator line connected to the crankcase and to the storage container; and a separate pump located in the separator line.

19. A steam generator according to claim 17 wherein the power supply includes solar panels and magnetrons.

20. A steam generator according to claim 17 including;

separator means including a separator line connected to the crankcase to remove water from the crankcase and deliver the water to the storage container;

and wherein the power supply includes solar panels and magnetos.

* * * * *